US012723208B2

(12) United States Patent
Kim et al.

(10) Patent No.: US 12,723,208 B2
(45) Date of Patent: Sep. 1, 2026

(54) IMPURITY REMOVAL AMOUNT PREDICTION METHOD IN CHEMICAL PROCESS

(71) Applicant: KWANGWOON UNIVERSITY INDUSTRY-ACADEMIC COLLABORATION FOUNDATION, Seoul (KR)

(72) Inventors: Yeonsoo Kim, Seoul (KR); Yungun Jung, Seoul (KR); Gyeonggwan Jeon, Seoul (KR); Hyungjun Kim, Seoul (KR)

(73) Assignee: KWANGWOON UNIVERSITY INDUSTRY—ACADEMIC COLLABORATION FOUNDATION, Seoul (KR)

( * ) Notice: Subject to any disclaimer, the term of this patent is extended or adjusted under 35 U.S.C. 154(b) by 119 days.

(21) Appl. No.: 18/620,543

(22) Filed: Mar. 28, 2024

(65) Prior Publication Data

US 2024/0327733 A1 Oct. 3, 2024

(30) Foreign Application Priority Data

Mar. 31, 2023 (KR) ..... 10-2023-0043224

(51) Int. Cl.
*C10G 65/12* (2006.01)
*G06F 15/18* (2006.01)

(52) U.S. Cl.
CPC ..... *C10G 65/12* (2013.01); *C10G 2300/1044* (2013.01); *C10G 2300/202* (2013.01); *C10G 2300/70* (2013.01)

(58) Field of Classification Search
CPC ..... G06N 3/08; G06N 20/00; G06N 3/02; G06N 3/0499; G05B 13/042;
(Continued)

(56) References Cited

U.S. PATENT DOCUMENTS 6,185,470 B1 * 2/2001 Pado ..... G05B 13/027 706/23
2021/0406690 A1 * 12/2021 Ramachandran .... G06N 3/0464

OTHER PUBLICATIONS

Artificial neural network modeling techniques applied to the hydrodesulfurization process, mathematical and computer modeling, 49, 207-214 (Year: 2009).*

(Continued)

*Primary Examiner* — Randy Boyer
*Assistant Examiner* — Juan C Valencia

(57) ABSTRACT

An impurity removal amount prediction method in chemical process is provided. The impurity removal amount prediction method in chemical process according to the embodiments of the present invention comprises making neural network models learn using data from a chemical process and predicting removal amounts of impurities removed in the chemical process using the learned neural network models. The impurities are included in the feed supplied to reactors of the chemical process and are removed by reacting with catalysts disposed in the reactors. The reactors include a first reactor and a second reactor arranged in parallel. The neural network models include a first neural network model applied to the first reactor and a second neural network model applied to the second reactor. The neural network models learn in the direction to minimize the difference between the output data of the first neural network model and the second neural network model.

6 Claims, 10 Drawing Sheets

(58) Field of Classification Search
CPC ..... G05B 13/027; G05B 13/0265; G05B 23/0283; G05B 2219/24065; G05B 23/0294; G05B 2219/32193; G05B 2219/39271; G05B 2219/41054; G05B 2219/33027; G05B 2219/33025; G05B 2219/32335; G05B 2219/25255; C10G 65/12; C10G 2300/1044; C10G 2300/202; C10G 2300/70; C10G 45/72; C10G 65/14
See application file for complete search history.

(56) References Cited

OTHER PUBLICATIONS

Predicted Effects Of Heavy Feeds on the Deactivation of a Commercial Atmospheric Residue Desulfurization Catalyst System , Energy Fuels, 32, 5480-5488 (Year: 2018).*
Enrique Arce-Medina et al., "Artificial neural network modeling techniques applied to the hydrodesulfurization process," Mathematical and Computer Modeling, 2009.
Dduha Chehadeh et al., "Predicted Effects of Heavy Feeds on the Deactivation of a Commercial Atmospheric Residue Desulfurization Catalyst System," Energy Fuels, 2018.
Kaixun He et al., "Application of Generative Adversarial Network for the Prediction of Gasoline Properties," Chemical Engineering Transactions, 2020.
Aminu Alhaji Hamisu, "Petroleum Refinery Scheduling with Consideration for Uncertainty," Cranfield Universtiy, PhD Thesis, Jul. 2015.

* cited by examiner

Minimum = Q1 - 1.5*IQR, Maximum = Q3 + 1.5*IQR, IQR = Q3 - Q1

IMPURITY REMOVAL AMOUNT PREDICTION METHOD IN CHEMICAL PROCESS

BACKGROUND OF THE INVENTION

1. Field of the Invention

The present invention relates to an impurity removal amount prediction method in chemical process.

2. Description of the Related Art

Efforts are being made to find and develop alternative resources due to limited crude oil reserves and environmental pollution issues. While demand for heavy oil products such as bunker oil is decreasing, demand for light oil products such as LPG, naphtha, and propylene is increasing. Additionally, impurities such as sulfur and metals in heavy oil cause environmental pollution problems during the refining process. In this way, heavy oil is being lightened in response to strengthening environmental regulations and decreasing demand.

The RDS (Atmospheric Residue Desulfurization) process uses HS AR (High Sulfur Atmospheric Residue) produced in the CDU (Crude Distillation Unit) process and undergoes hydrogenation and catalytic reaction to produce T-AR (Treated Atmospheric Residue), a raw material for the FCC (Fluid Catalytic Cracking) process. T-AR is later converted into high value-added materials such as gasoline or propylene in the FCC process. HS AR used in the RDS process contains impurities such as sulfur, nitrogen, metal elements, and CCR (Conradson Carbon Residue), which not only causes environmental regulation issues but also affects the purity of the product. If HS AR is directly input in the FCC process, it is poisonous to the catalyst in the reactor and is inefficient in producing high-purity products, so a pretreatment process to remove impurities is necessary, and the RDS process serves as a pretreatment to remove impurities in high-sulfur heavy oil.

In the RDS process, impurities are removed through a reactor containing a catalyst layer. As the catalyst is used, aging occurs due to various factors such as deposition of metal elements, and the catalyst must finally be replaced. In other words, the inactivity of the catalyst leads to shortening the life of the catalyst. Since catalysts incur a lot of cost when replaced, it is necessary to remove impurities as efficiently as possible within the limited period of use of the catalyst. However, it is not only difficult but also inefficient to measure and utilize all the many variables and parameters required for catalyst information and removal amount calculation during actual process operation.

SUMMARY OF THE INVENTION

The present invention provides a method for predicting removal amounts of impurities in chemical process.

The other objects of the present invention will be clearly understood with reference to the following detailed description and the accompanying drawings.

An impurity removal amount prediction method in chemical process according to the embodiments of the present invention comprises making neural network models learn using data from a chemical process and predicting removal amounts of impurities removed in the chemical process using the learned neural network models.

The impurities are included in the feed supplied to reactors of the chemical process and are removed by reacting with catalysts disposed in the reactors.

The reactors include a first reactor and a second reactor arranged in parallel.

The neural network models include a first neural network model applied to the first reactor and a second neural network model applied to the second reactor.

The neural network models learn in the direction to minimize the difference between the output data of the first neural network model and the second neural network model.

The chemical process may include RDS (Atmospheric Residue Desulfurization) process, the feed may contain HS AR (High Sulfur Atmospheric Residue), and the impurities may include sulfur, nitrogen, metal elements, and CCR (Conradson Carbon Residue).

The correlation between input data and output data of the neural network models may be fixed to a positive value using weight clipping.

The removal amounts of the impurities may be predicted using an aging factor indicating the inactivity of the catalysts.

The neural network models may be updated daily by applying a receding horizon method after learning for a certain period of time.

The neural network models may learn using variables that affect the removal amounts of the impurities as features.

According to the embodiments of the present invention, the removal amounts of impurities in chemical process can be predicted. For example, a reliable impurity: removal amount prediction model that is learned to ensure physicochemical consistency based on a neural network model can be built, and the impurity removal amounts in the RDS process can be predicted. Through an optimization process, the prediction model can suggest process operating conditions that can efficiently remove impurities for used amount of catalyst, and costs due to catalyst replacement can be reduced.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF SPECIFIC EMBODIMENTS

Hereinafter, a detailed description will be given of the present invention with reference to the following embodiments. The purposes, features, and advantages of the present invention will be easily understood through the following embodiments. The present invention is not limited to such embodiments, but may be modified in other forms. The embodiments to be described below are nothing but the ones provided to bring the disclosure of the present invention to perfection and assist those skilled in the art to completely understand the present invention. Therefore, the following embodiments are not to be construed as limiting the present invention.

Terms like 'first', 'second', etc., may be used to indicate various components, but the components should not be restricted by the terms. These terms are only used to distinguish one element, component, region, layer or section from another region, layer or section. A first element, component, region, layer or section could be termed a second element, component, region, layer or section without departing from the teaching of the embodiments of the present invention.

The terminology used herein is for the purpose of describing particular embodiments only and is not intended to limit the invention. It is to be understood that the singular forms "a," "an," and "the" include plural references unless the context clearly dictates otherwise. It will be further understood that the terms "comprises" or "has," when used in this specification, specify the presence of stated features, integers, steps, operations, elements, and/or components, but do not preclude the presence or addition of one or more other features, integers, steps, operations, elements, components, and/or groups thereof.

[RDS (Atmospheric Residue Desulfurization) Process]

Figure 1:
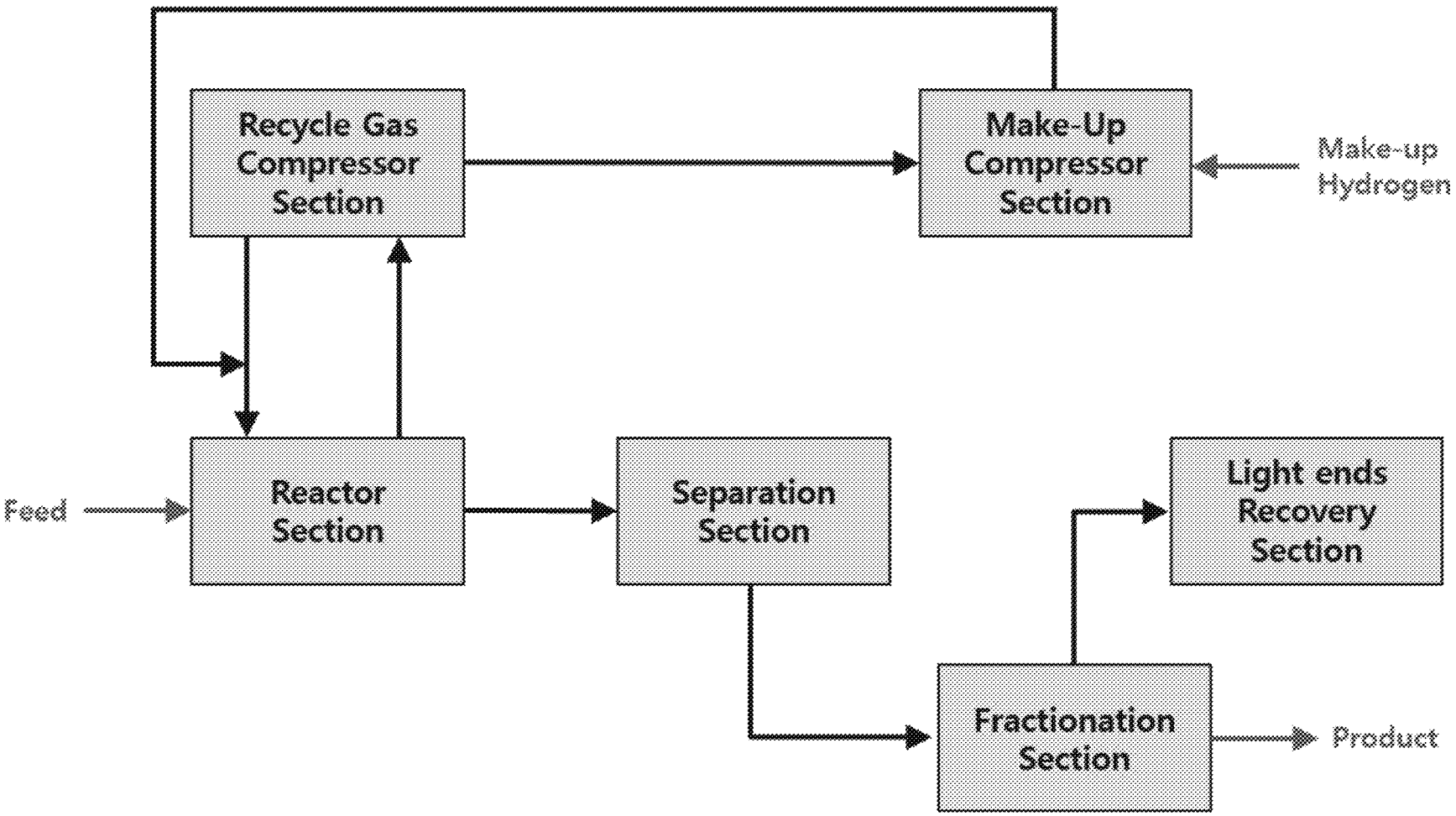
FIG. 1 is a block diagram schematically showing a RDS process.

FIG. 1 is a block diagram schematically showing a RDS process.

Referring to FIG. 1, the RDS process is divided into six main sections of a reactor section, a recycle gas compressor section, a make-up compressor section, a separation section, a fractionation section, and a light ends recovery section.

In the reactor section, the feed is converted to a product through a chemical reaction, and impurities contained in the feed are removed. The reactor section is operated at a high hydrogen partial pressure and a temperature range of about 350 to 401° C. because hydrogenation reaction occurs through a metal catalyst. In the embodiments of the present invention, a model for predicting the removal amounts of impurities was constructed using the reactor structure and actual plant data, considering the reactor section as the main section.

Figure 2:
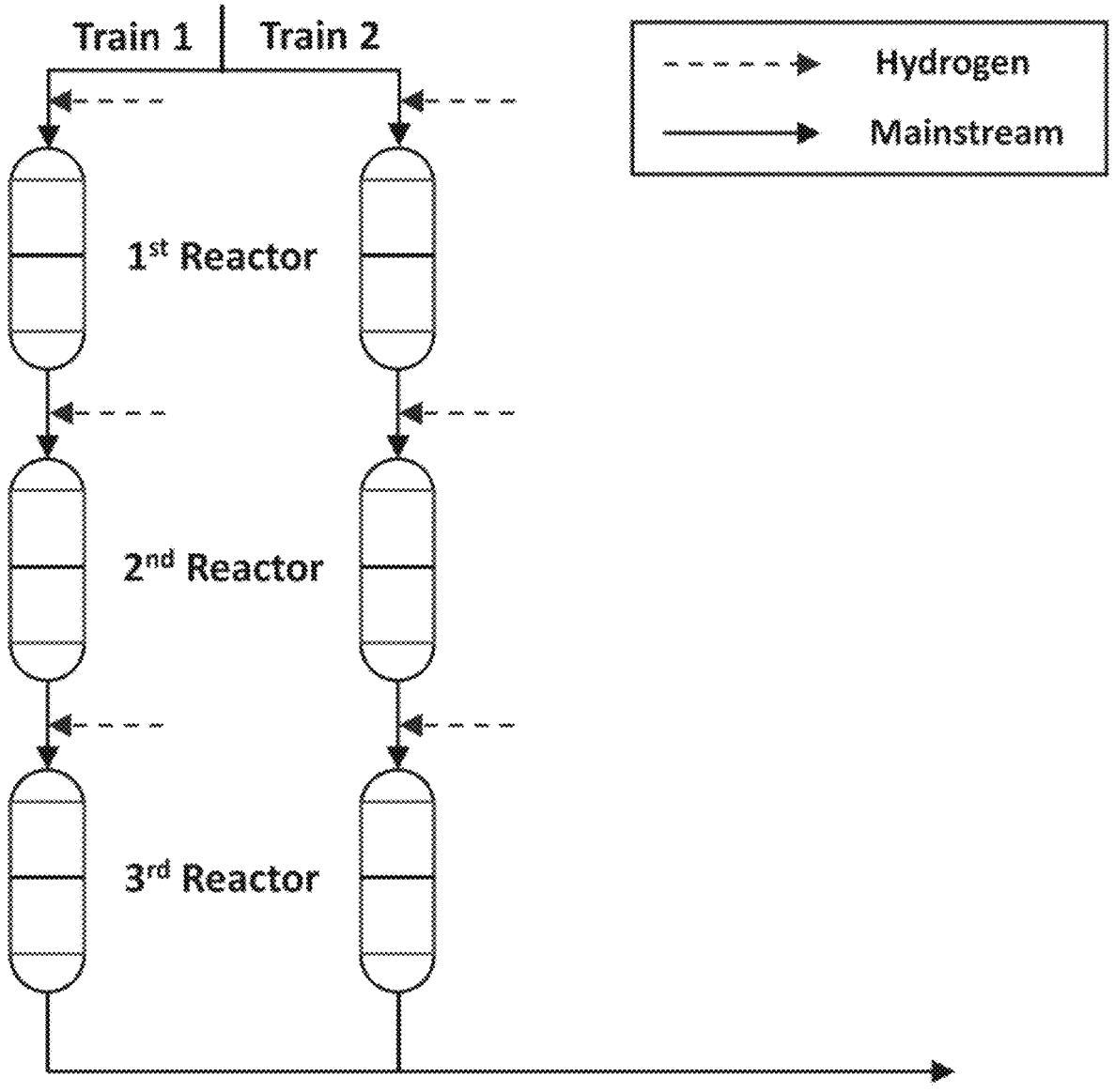
FIG. 2 shows a flow diagram of reactors in the RDS process.

FIG. 2 shows a flow diagram of reactors in the RDS process.

Referring to FIG. 2, the reactors of the RDS process may be composed of a total of six reactors, three in each of two parallel modules. Because catalysts are placed and used in the reactors, reactions such as HDM (Hydrodemetallization), HDS (Hydrodesulfurization), HDN (Hydrodenitrogenation), and HDCCR (Hydrodeconradson-carbon-residue) occur in each reactor. Within the reactor, depending on the reaction rate, the catalytic reaction proceeds in that order, starting with HDM, then HDS, HDN, and HDCCR, and impurities are removed. Table 1 below shows the location in the reactors where the catalytic reactions occur for each impurity.

TABLE 1

| | | HDS | HDN | HDM | HDCCR |
|---|---|---|---|---|---|
| 1st reactor | Upper | | | ○ | |
| | Lower | | | ○ | |
| 2nd reactor | Upper | | | ○ | |
| | Lower | ○ | | ○ | ○ |
| 3rd reactor | Upper | ○ | ○ | ○ | ○ |
| | Lower | ○ | ○ | ○ | ○ |

Since the feed, HS AR (High Sulfur Atmospheric Residue), is a carbon compound with a large molecular weight, the carbon chains and rings must first be broken to remove impurities. That is, after saturating the unsaturated bond using hydrogen, the carbon bond is broken and the impurities are removed from the carbon compound. The impurities react with the hydrogen and are converted into $NH_3$, $H_2S$, etc. and are then removed through an apparatus such as an absorber. Metal elements are decomposed on the catalyst surface and converted to metal sulfides. These metal sulfides are deposited on the catalyst surface and block reaction points within the catalyst pores, thereby increasing the inactivity of the catalyst and reducing the life of the catalyst. After removal of the impurities, the carbon compound is decomposed into final products such as LPG, diesel, naphtha, and T-AR through hydrogenation reaction such as olefin saturation reaction and aromatic saturation reaction, and hydrocracking reaction.

The materials converted through the reactors are separated into gas streams such as hydrogen, hydrogen sulfide, and ammonia, and liquid streams such as naphtha, diesel, and T-AR products through the separation section. Hydrogen in the separated gas plays an important role in controlling the hydrogen partial pressure in the reactor section and is therefore recycled to the reactor section through the recycle section. Finally, the product stream discharged through the separation section is distilled through the classification section into the final products LPG, diesel, naphtha, and T-AR, and T-AR is input as a raw material for the FCC (Fluid Catalytic Cracking) process.

By collecting actual plant data, the amount of impurities contained in raw materials and products can be measured, and the removal amounts of the impurities can be calculated through the measured data and material balance equation.

[Neural Network Prediction Model]

1. Data Preprocessing

In a neural network model training, data preprocessing processes such as data cleaning, data reduction, and transformation are necessary to obtain a more accurate prediction model. Actual plant data used in the embodiments of the present invention are largely divided into two types of data, RDS process operating condition data and material composition data. The data were obtained for 120 days, the period of a single catalyst cycle. Average daily values were used because the operating temperature of the process is usually determined on a daily basis, therefore there is no need to predict performance in shorter intervals. In addition, the material composition was not measured in real time. Data preprocessing was performed because there were missing and abnormal values in the actual measured data.

Methods for handling the missing values can be divided into two types. The first is to delete the missing values, and the second is to fill in the missing values and interpolate. Since the actual data used in the embodiments of the present invention were partially missing, missing values were processed through interpolation and moving average functions and noise was removed.

Figure 15:
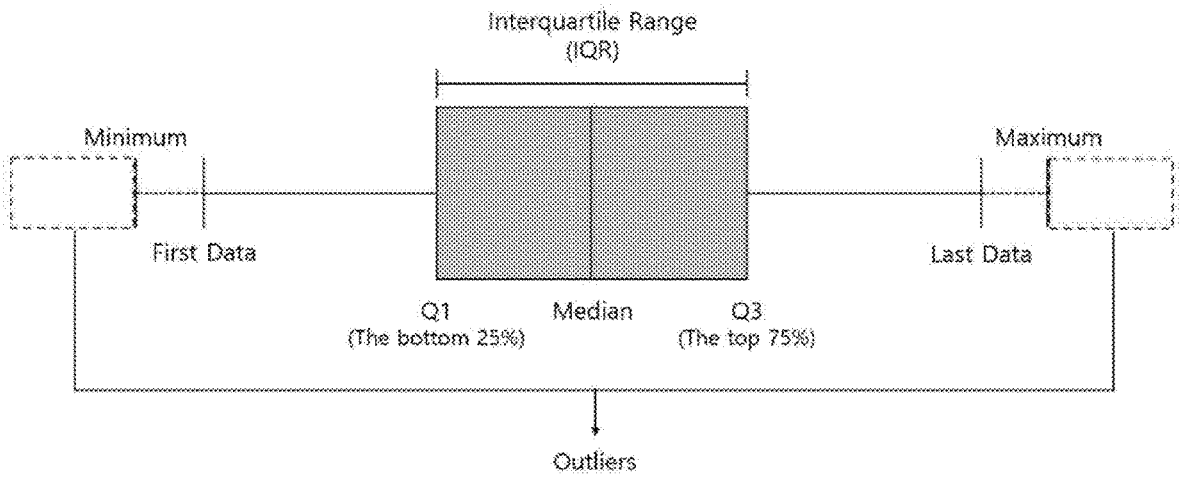
FIG. 15 shows a method for setting outliers using an Interquartile Range (IQR).

After processing the missing values, outliers were set using the IQR (InterQuartile Range) method to remove abnormal values, and the abnormal values outside the range were processed as illustrated in FIG. 15. The IQR refers to the difference between the data values at the top 75% (Q3) to the bottom 25% (Q1) points of an ordered dataset. In other words, the IQR is the interval from the bottom 25% point to the top 75% point. The outliers were set using the IQR. The minimum value is the point obtained by subtracting the IQR multiplied by 1.5 from the bottom 25%, and the maximum value is the point obtained by adding the IQR multiplied by 1.5 to the top 75%. Values outside the minimum and the maximum were considered outliers. The abnormal values were replaced with the calculated average of the normal data closest to each abnormal value.

To improve learning accuracy, feature scaling is desirable. Because the units and value ranges of each feature are different, the scale of each data item was adjusted using a normalization method. Relatively large-scale data may have a large impact, and conversely, small-scale data may not have a significant impact. Likewise, if the range difference between data values is large when comparing data values, it is difficult to check whether the data has a proper influence on learning. To solve this problem, normalization is to scale each data to reflect the same range. The feature data was scaled to fit the range by setting the minimum value to 0 and the maximum value to 1 for all data ranges through the minimum-maximum normalization method as shown in the following formula.

$$\text{Minimum-maximum normalization: } X_{nom}=(x-X_{min})/(X_{max}-X_{min})$$

In addition, in the neural network model learning, the original data was preprocessed by performing unit conversion and computation process for calculations of conversion rate, mass flow rate, and cumulative amount, and removing rows and columns of unnecessary data.

2. Feature Selection

In order to obtain a good result in the training of neural network models, it is necessary to select appropriate features. If the neural network model uses features that do not effectively influence the outputs, it may result in the poor model accuracy. In the embodiments of the present invention, the domain knowledge was used to select major features that affect the impurity removal reactions, such as the upper and lower temperatures of reactors and the amounts of impurities in the feed. Reactor temperature is an important operating condition of the process. As the catalyst ages and its inactivity increases over time, the reactor temperature is manipulated to compensate for this and obtain the target product. In the embodiments of the present invention, in order to further improve the learning effect of the model, the reactor temperature data is multiplied by a negative value, the reciprocal is taken, and the data to which the exponential function is applied is added as variables ($\exp^{-1/Ttop}$, $\exp^{-1/Tbottom}$). These variables are inspired by the Arrhenius equation, which is related to the reaction rate equation.

Table 2 below shows features applied to the prediction model for each impurity.

TABLE 2

| | | | S | N | Ni | V | CCR |
|---|---|---|---|---|---|---|---|
| Impurity feed flow rate | | | ○ | ○ | ○ | ○ | ○ |
| Temperature and its exponential form | 1st reactor | Upper | | | ○ | ○ | |
| | | Lower | | | ○ | ○ | |
| | 2nd reactor | Upper | | | ○ | ○ | |
| | | Lower | ○ | | ○ | ○ | ○ |
| | 3rd reactor | Upper | ○ | ○ | ○ | ○ | ○ |
| | | Lower | ○ | ○ | ○ | ○ | ○ |

Each reactor has separate catalyst layers, therefore the impurities to be removed are different for each reactor location. Thus, the models for predicting the removal amounts of each impurity were constructed separately. Accordingly, only the temperature information for the relevant catalyst loading part and the feed flow rate information for the target impurity were used to create each feature set.

Hydrogen partial pressure according to hydrogen flow rate is also an important variable within the reactor. Hydrogen is the main ingredient that causes hydrogenation reactions, and plays various roles such as converting unsaturated materials to saturated states, causing ring-opening reactions, and suppressing coke production. However, in the actual process, it is injected according to the AR injection flow rate to meet the hydrogen flow rate required for the hydrogenation reaction. Additionally, if there is insufficient hydrogen for the catalytic reaction during the process of passing through the reactor, hydrogen is supplemented in the make-up compressor section. As such, the hydrogen flow rate was sufficiently provided and did not have a significant impact on the RDS process efficiency, so it was not selected as a feature.

3. Prediction Model Structure

The feed stream of the RDS process is divided in approximately equal proportions and fed into two trains, each of which is processed by three reactors. In the embodiments of the present invention, two neural network models were applied for each impurity component to predict the removal amount of impurities. For example, to predict the removal amount of impurity N, an FCNN (Fully connected neural network) of the same structure was assigned to each of the two trains, and the output of each neural network model predicted the removal amounts of the impurities in each train.

The neural network output corresponding to each train was multiplied by an aging factor as shown in the following equation. Based on the maximum capacity and cumulative processed amount of CCR, C7, and metal elements, as the cumulative processed amount per day increases, the value of the aging factor decreases according to the formula.

$$A_{T1,i} = \prod_{j=\{CCR,C7,Ni,V\}} \times \frac{\text{Maximum capacity of } j - \text{Cumulative processed amount of } j}{\text{Maximum capacity of } j}$$

$$AF_{T1,i} = w_{1,T1,i}(1 - \exp - A_{T1,i}) + w_{2,T1,i}$$

$$A_{T2,i} = \prod_{j=\{CCR,C7,Ni,V\}} \times \frac{\text{Maximum capacity of } j - \text{Cumulative processed amount of } j}{\text{Maximum capacity of } j}$$

$$AF_{T2,i} = w_{1,T2,i}(1 - \exp - A_{T2,i}) + w_{2,T2,i}$$

Here, i denotes each impurity and $T_1$ and $T_2$ denote the reactor trains. ω1 and ω1 will be estimated when training. The maximum capacity was calculated based on the fact that the maximum usage cycle of the catalyst at the factory is set to 6 months. The average injection amounts of CCR, C7, and metal elements were calculated using the data from the initial operation date to the current date. Since CCR, C7, and metal elements are components that greatly affect catalyst deactivation, the aging factor must be determined by considering CCR, C7, and metal elements. CCR and C7 form coke through the hydrogenation process and, like metal elements, are deposited in the pores of the catalyst and inside the reactor. In other words, as the cumulative processed amount of CCR, C7, and metal elements increases, the amount of metal sulfides and deposited coke increases, and the deactivation of the catalyst also increases. This means a decrease in the aging factor value according to the increase in the cumulative processed amount. The minimum value of the parameters of the aging factor function according to catalyst deactivation was set. During actual plant operation, differences in the removal amounts of impurities may occur due to catalyst deactivation, which may affect the yield of the product. The life of a catalyst varies depending on the operating conditions of the process, and in reality, the inactivity of the catalyst does not become completely 0. Although the maximum capacity was set at 6 months in the embodiments of the present invention, the catalyst may have some conversion even after 6 months. To ensure this trend, the weight of the aging factor was set to 0.01 or more.

Figure 3:
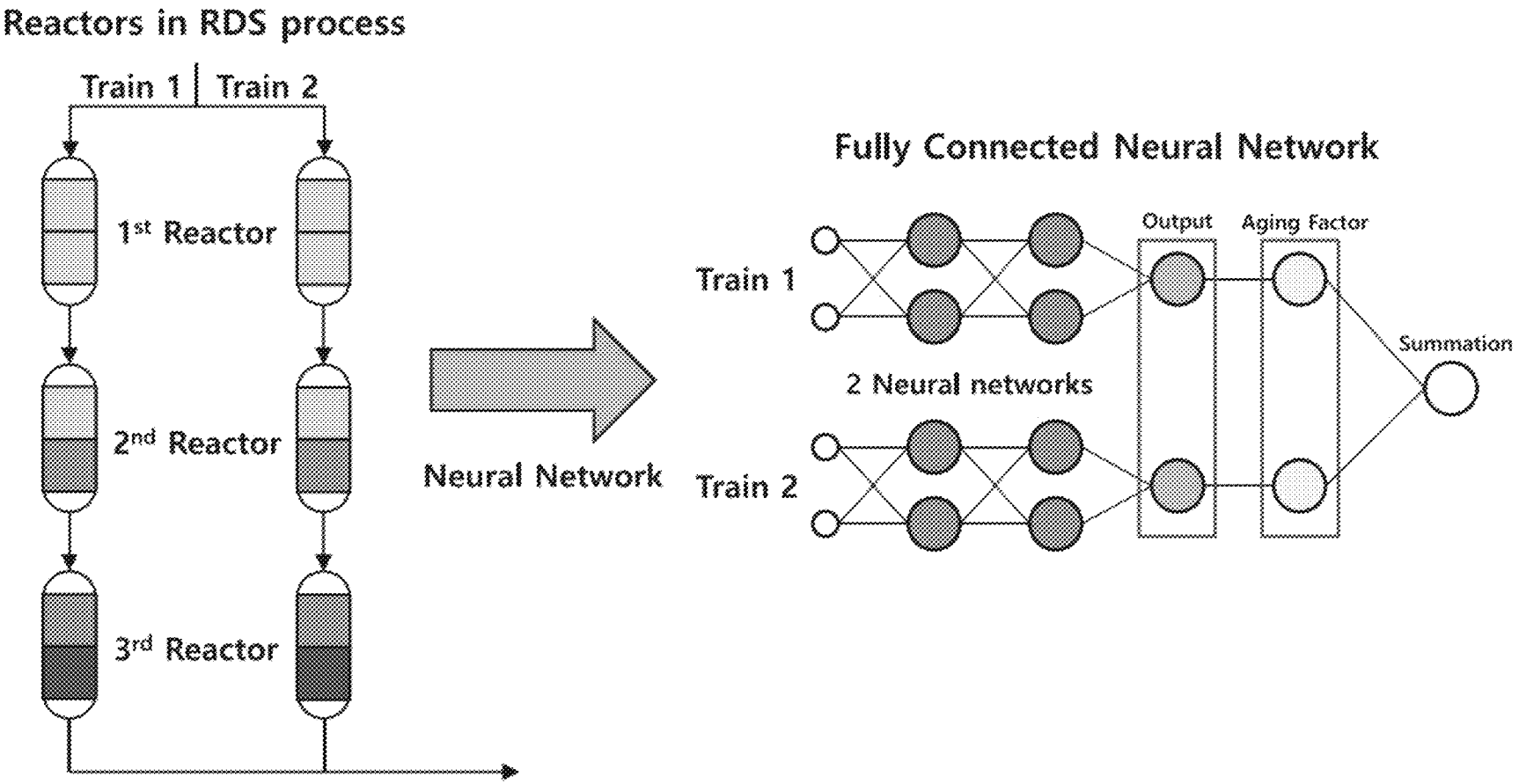
FIG. 3 shows the neural network model structure for predicting removal amounts of impurities.

The final removal amount of impurity i through both trains $T_1$ and $T_2$ was calculated with the neural network outputs $NN_{T1,i}$ and $NN_{T2,i}$, and aging factors $AF_{T1,i}$ and $AF_{T2,i}$ as follows. This neural network model is shown in FIG. 3.

$$Y_i = AF_{T1,i} \times NN_{T1,i} + AF_{T2,i} \times NN_{T2,i}$$

To reduce the discrepancy between the final output calculated in this way and the actual plant data, the following objective function was set. The FCNN weights and aging factors were updated in the direction that minimizes the objective function.

$$J(w) = [Y_i - Y_{i,data}]^2 + \mu_{imbalance}[Y_{T1,i}(X_{T1,i}) - Y_{T2,i}(X_{T2,i})]^2 + \mu_{L2}\|w\|^2$$

The Adam (Adaptive Moment Estimation) algorithm was used as the optimization algorithm. To prevent overfitting and improve generalization performance, the L2 regularization method was used. The hyperparameters applied to the train 1 model and the train 2 model are the same, and the detailed hyperparameters applied to the models are shown in Table 3.

TABLE 3

| | S | N | Ni | V | CCR |
|---|---|---|---|---|---|
| The Number of Hidden Layers | | | 2 | | |
| The Number of Hidden Nodes | | | 2 | | |
| Activation Function | | | ELU | | |
| Optimizer | | | Adam Optimizer | | |
| Training Data | | | Recent 28 days data | | |
| Epochs | | | 5000 | | |

TABLE 3-continued

| | S | N | Ni | V | CCR |
|---|---|---|---|---|---|
| Learning Rate | 0.001 | 0.0001 | 0.001 | 0.001 | 0.001 |
| Regularization | | | L2 regularization, $\mu$ = 1E−4 | | |
| Penalty Tuning Parameter $\mu_p$ for Imbalance | 7 | 7 | 500 | 500 | 30 |

The operating process of the constructed FCNN model first inputs data from the input layer through the initial value of the set weight, and performs linear transformation in the process of moving to the first hidden layer. The value output from the first hidden layer can be applied to linearly transformed data through a nonlinear activation function to express nonlinearity and the model can learn more diverse processes. The output value of the first hidden layer to which the non-linear activation function is applied is input as the input data of the second hidden layer, and as above, it is input to the output layer through the same process such as linear transformation and application of the non-linear activation function. Finally, the output value of the output layer input through linear transformation is predicted data of the model, and no activation function is applied to it. The nonlinear activation function used between hidden layers used the ELU (Exponential Linear Unit) function, and the initial value of the set weight was applied differently to each model for each impurity. Since the learning results of the model vary depending on how the initial value of the weight is set, weight initialization is important in outputting good result data during the model learning process by preventing gradient disappearance, runaway, and overfitting. Since the ELU function, which is a variant form of the RELU (Rectified Linear Unit) function, was used in the embodiments of the present invention, He initialization was applied to the model and used as a weight initialization method.

4. Training Strategies for Ensuring Physiochemical Consistency

Weight Clipping for Positive Correlation

Clipping method to the neural network model restricts the weights to positive values. This is to ensure a positive correlation between the input data and the result data output from the model. In the RDS process, the removal amount must tend to increase as the temperature of the reactor increases, so if the inactivity of the catalyst is not taken into account, the output data value should also tend to increase as the temperature data value increases. This means that the input features must have a positive correlation with the outputs of the FCNN model before the outputs are multiplied by the aging factor. Additionally, the injected amount of impurities in the input features and the outputs must have a positive correlation. By using weight clipping that fixes the weight to a positive value, the neural network can be trained while ensuring physical consistency.

Imbalance Learning Correction Between Two FCNN Models for Each Impurity

In order to prevent imbalances between the FCNN models for each impurity, a penalty term was introduced in the objective function. The reactors in each train have similar operating conditions and feed flow rates, thus, the impurity removal amounts should not be significantly different. The prediction values of the removal amounts from the two FCNN models should be similar and the models should be trained in a balanced manner. However, since the models have the same a risk of one FCNN dominating the structure, there is prediction of removal amounts. To prevent this problem, the penalty term ($\mu_{imbalance}[Y_{T1,i}(X_{T1,i})-$ $Y_{T2,i}(X_{T2,i})]^2$) was added to the objective function that hinders the difference between the outputs of the FCNNS.

By adding the penalty term, the difference in result values between the models was set to minimize as the models are trained. Ultimately, as the difference in result values from the outputs of the two models decreases, the imbalance of learning biased toward one model is resolved and learning can be done evenly.

Application of Receding Horizon Method

Figure 16:
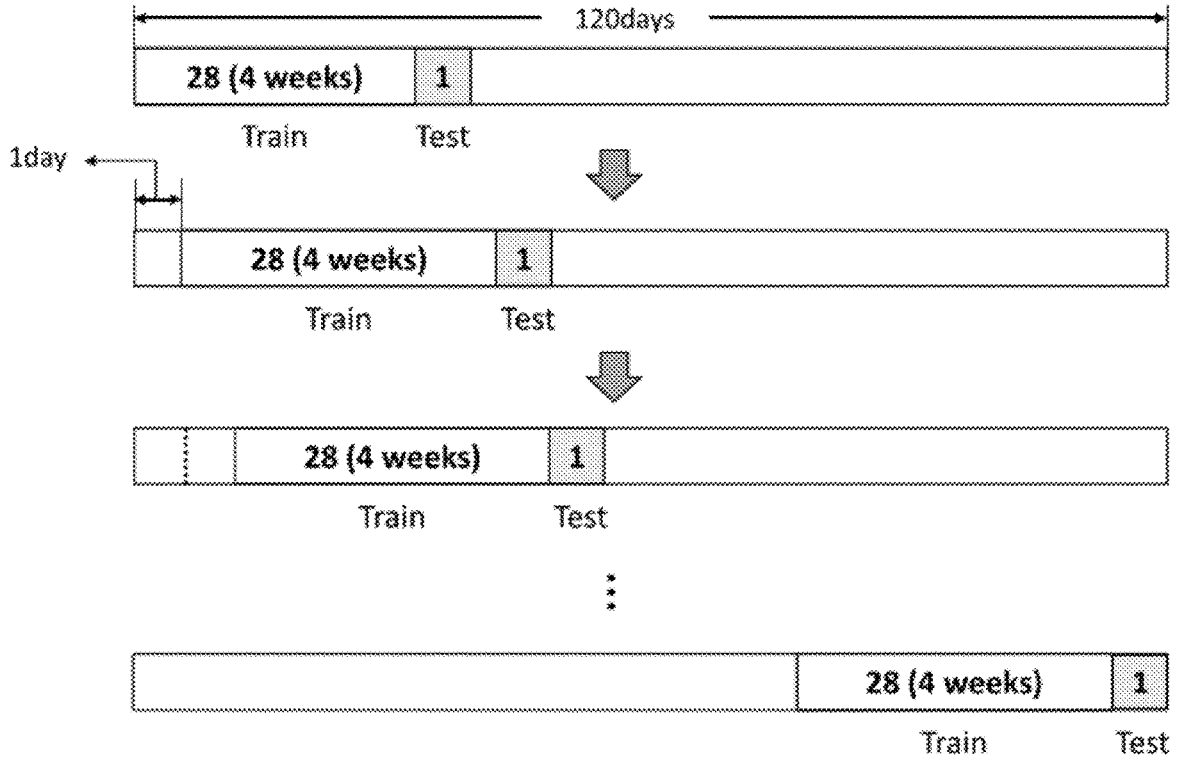
FIG. 16 shows a receding horizon training method.

The model continues to be trained using the reseeding horizon method over time. First, to collect sufficient data, the prediction model was trained using actual plant data of the first 28 day period. This model was tested with data from the 29th day. Then, the data of the 29th day were added as a new dataset, while the data from the oldest first day were discarded to create the latest 28 day data set and the model updated. Next, the updated model was tested using the data from the 30th day. With this receding method, the model was continuously updated using the latest 28 day data as schematically shown in FIG. 16. The model can smoothly adapt to changes in the reactor characteristics and catalyst aging over time.

[Analysis of Accuracy of the Prediction Model]

In the embodiments of the present invention, a total of 120 days of data from the normal operation period of the actual RDS process were used excluding seven and nine days of start-up and shut-down data, respectively. The latest four weeks of data were used to train the model, while data from the next single day were used to test the model.

The accuracy of the constructed model was calculated by comparing the predicted values with the actual plant data. Table 4 summarizes the results, including the average, maximum, and minimum values of the prediction errors for each impurity component. Using the training strategy including weight clipping, imbalance learning correction (balancing), and receding horizon, the maximum error was 9.20%, and the average error was 0.98-2.50%.

TABLE 4

| | S | N | Ni | V | CCR |
|---|---|---|---|---|---|
| Maximum Percent Error (%) | 4.32 | 6.29 | 8.22 | 4.54 | 9.20 |
| Average Percent Error (%) | 0.98 | 2.04 | 2.24 | 1.47 | 2.50 |
| Minimum Percent Error (%) | 7.02e−5 | 0.004 | 0.007 | 0.002 | 0.074 |

Figure 4:
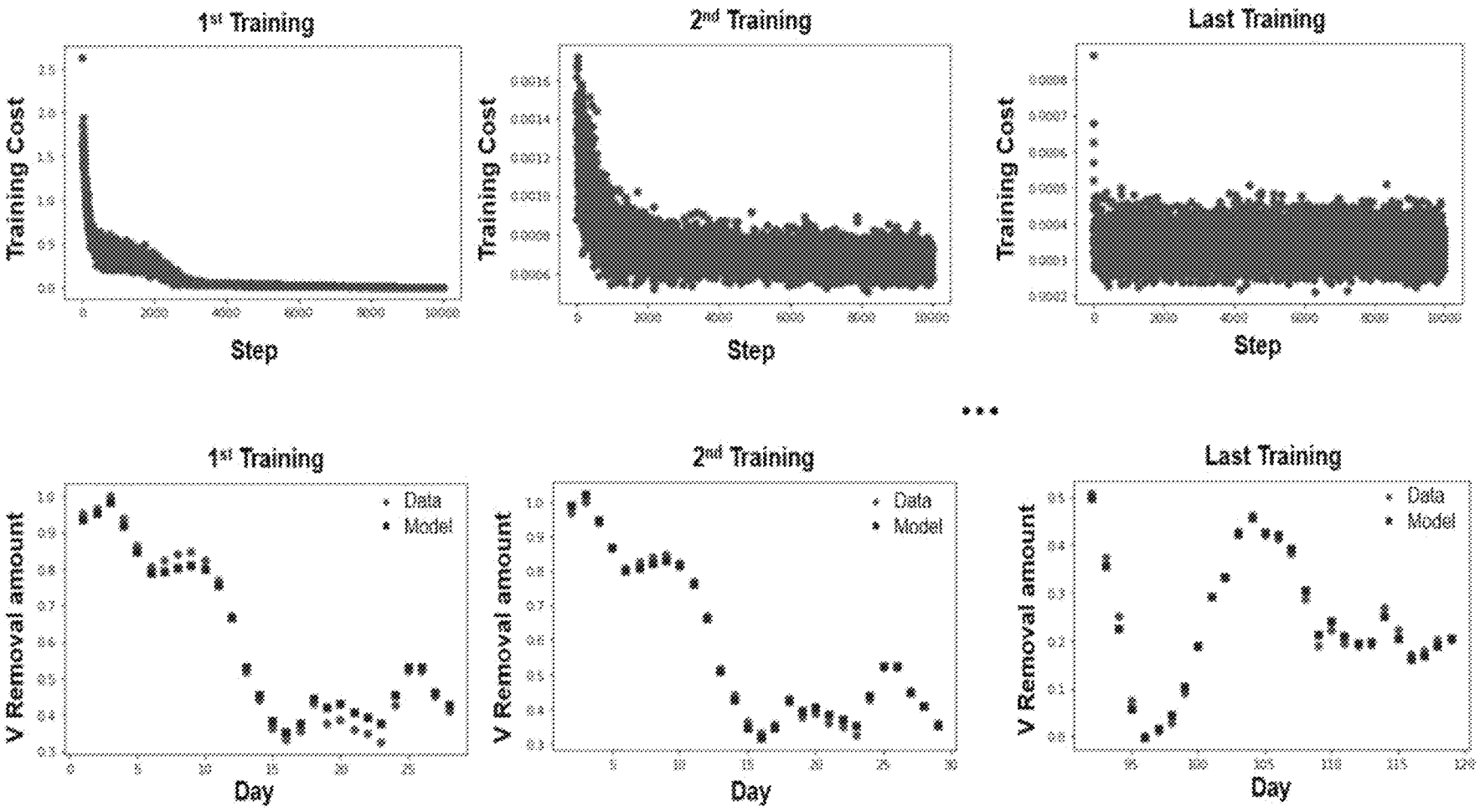
FIG. 4 shows a graph of the learning results of an impurity removal amount prediction model.
Figure 5:
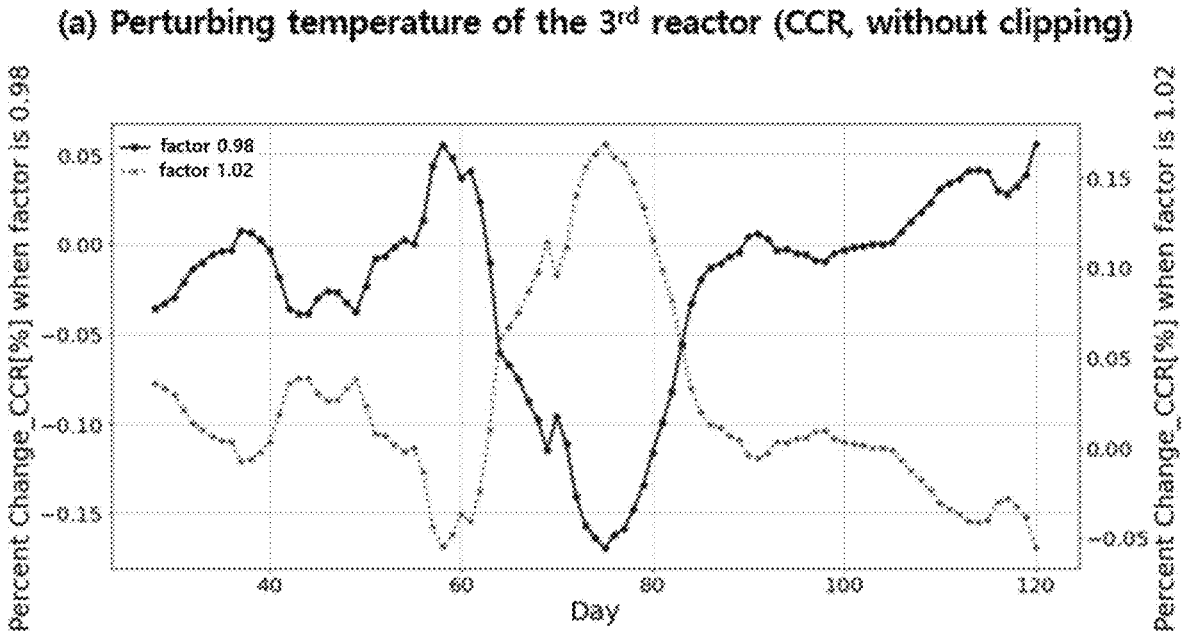
FIGS. 5 to 9 show changes in the removal amounts of the impurities according to an increase or decrease in variables when weight clipping is not applied.
Figure 6:
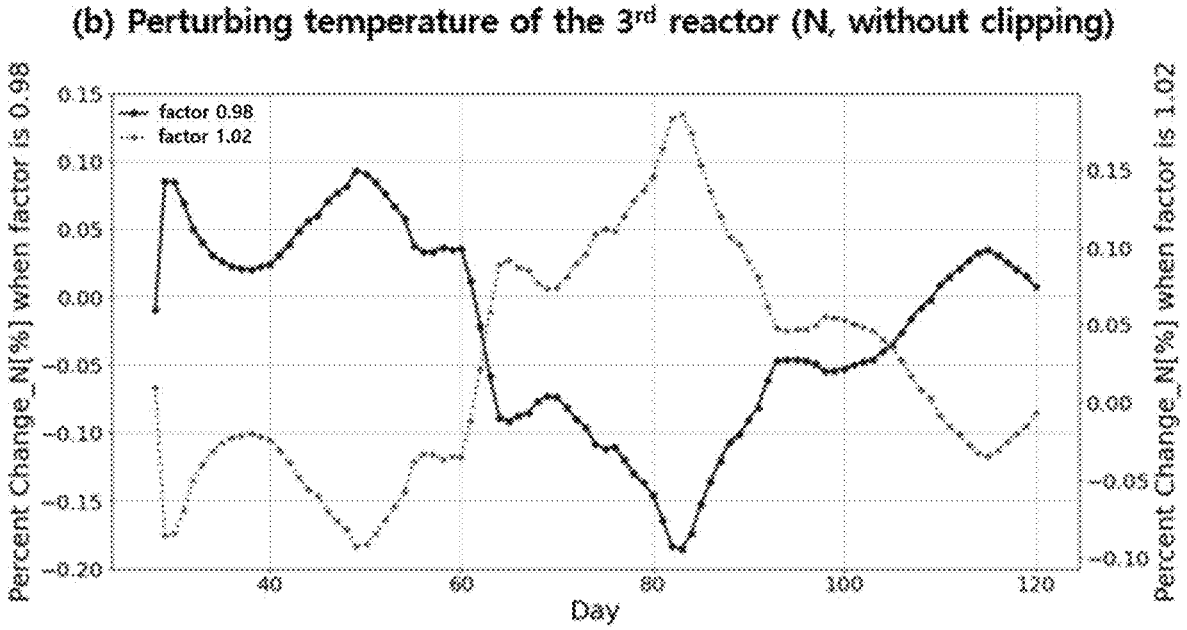
Figure 7:
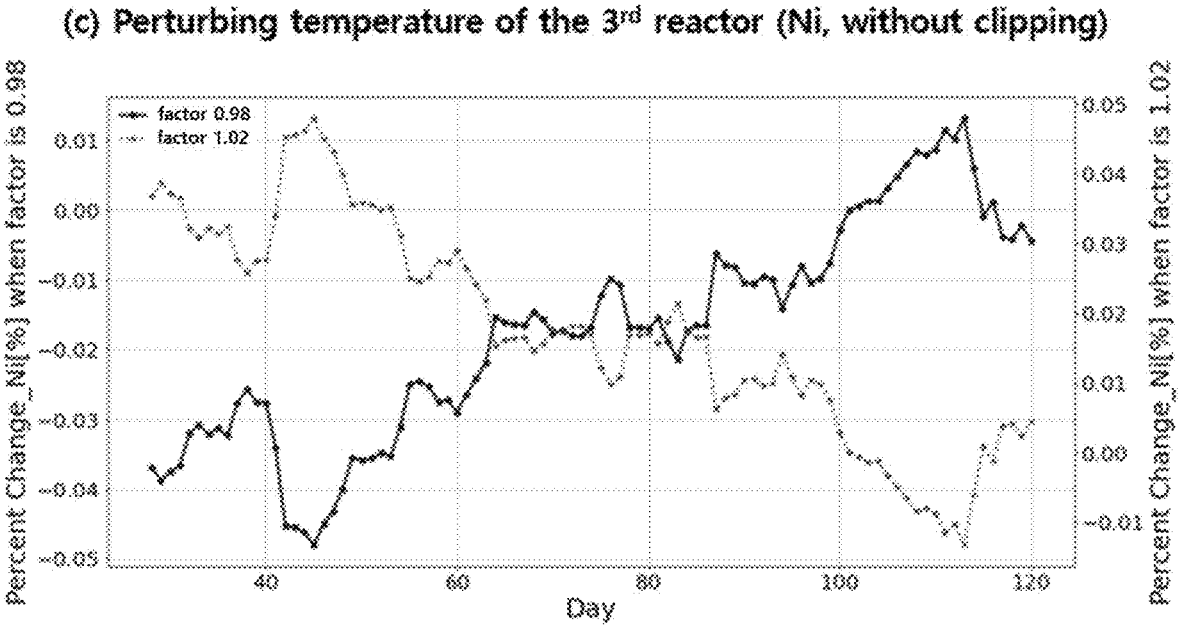
Figure 8:
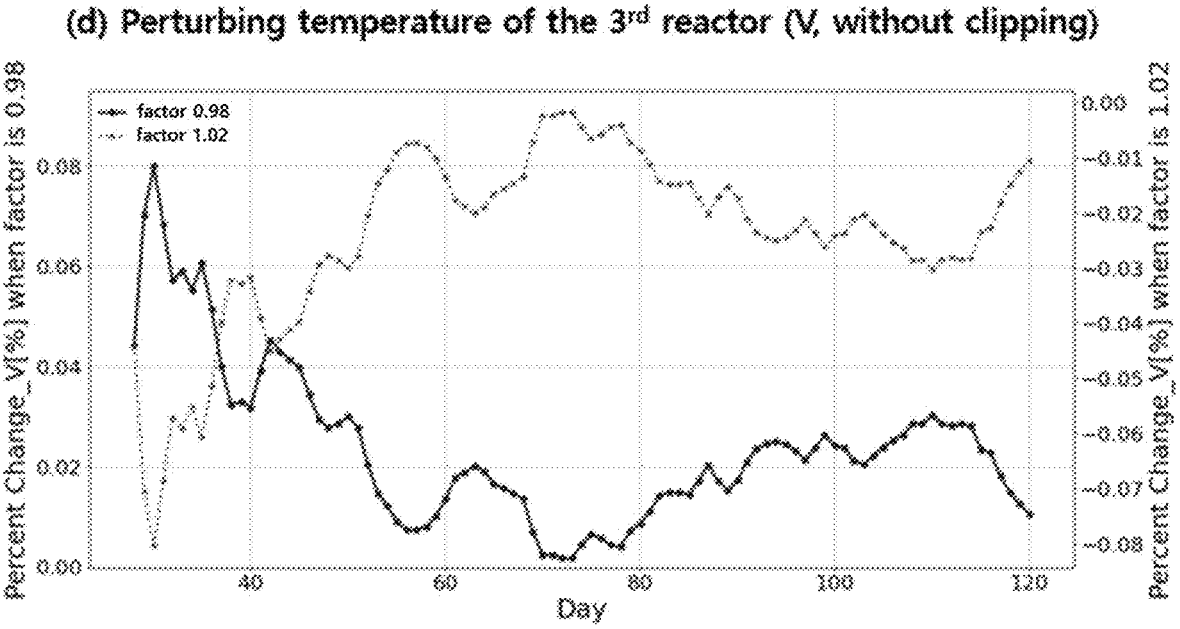
Figure 9:
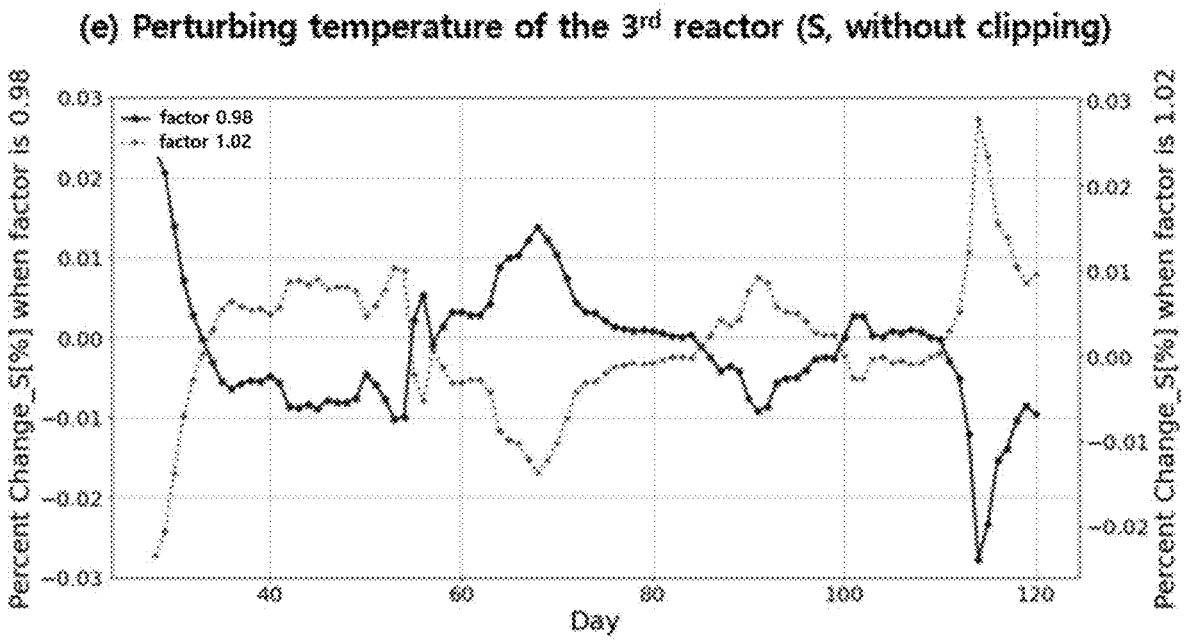
Figure 10:
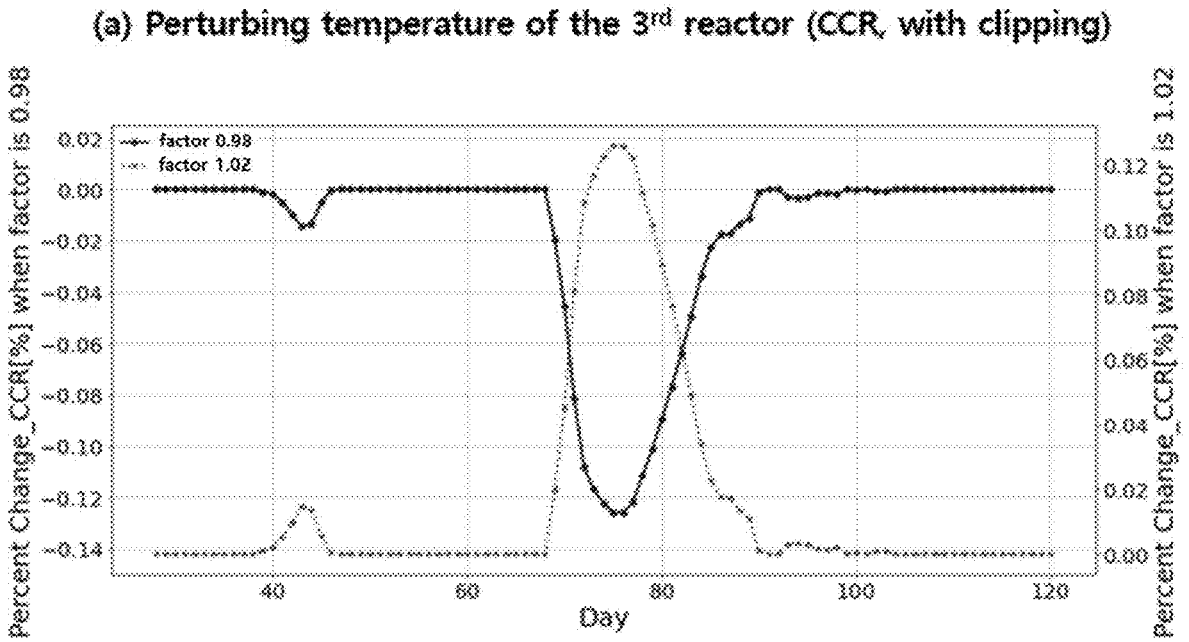
FIGS. 10 to 14 show changes in the removal amounts of the impurities according to an increase or decrease in variables when weighted clipping is applied.
Figure 11:
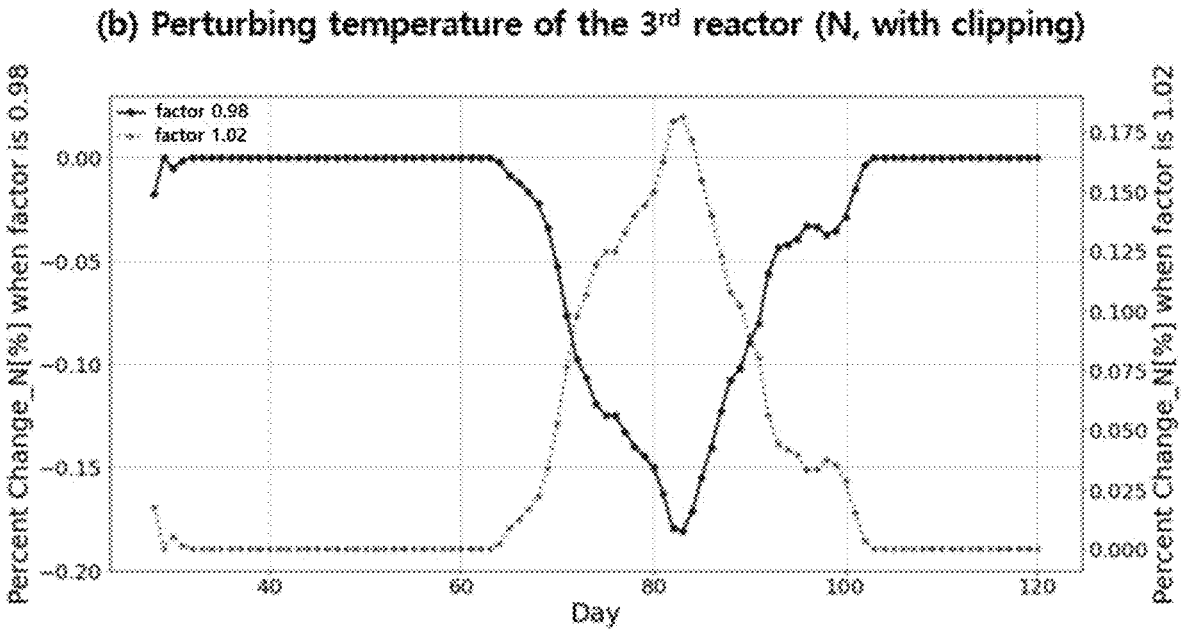
Figure 12:
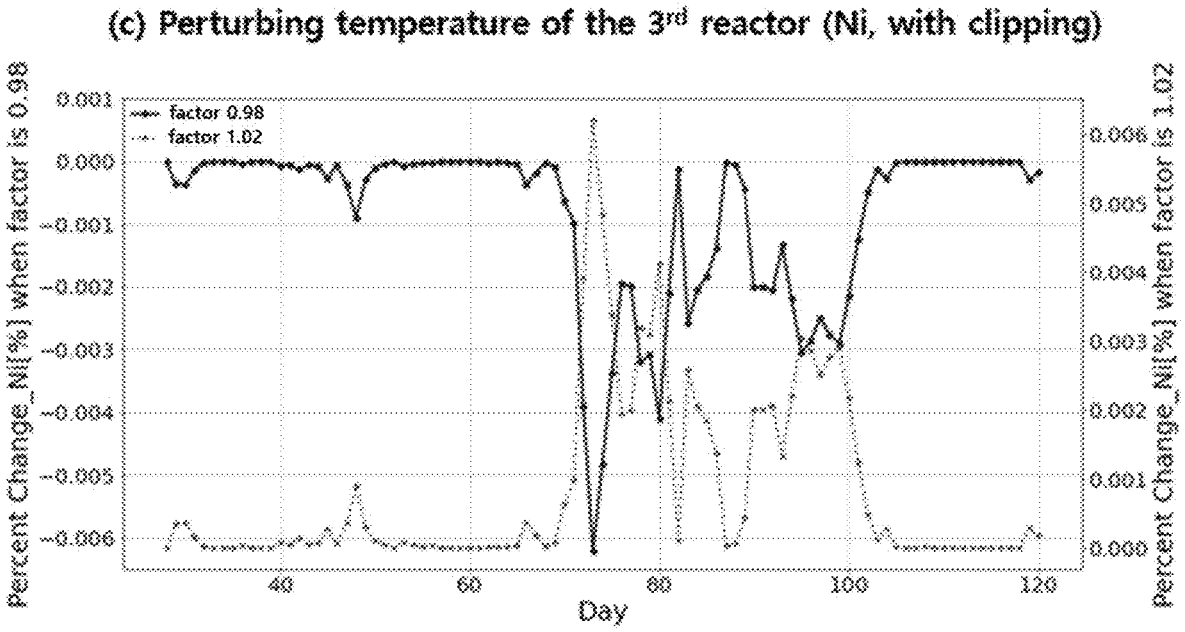
Figure 13:
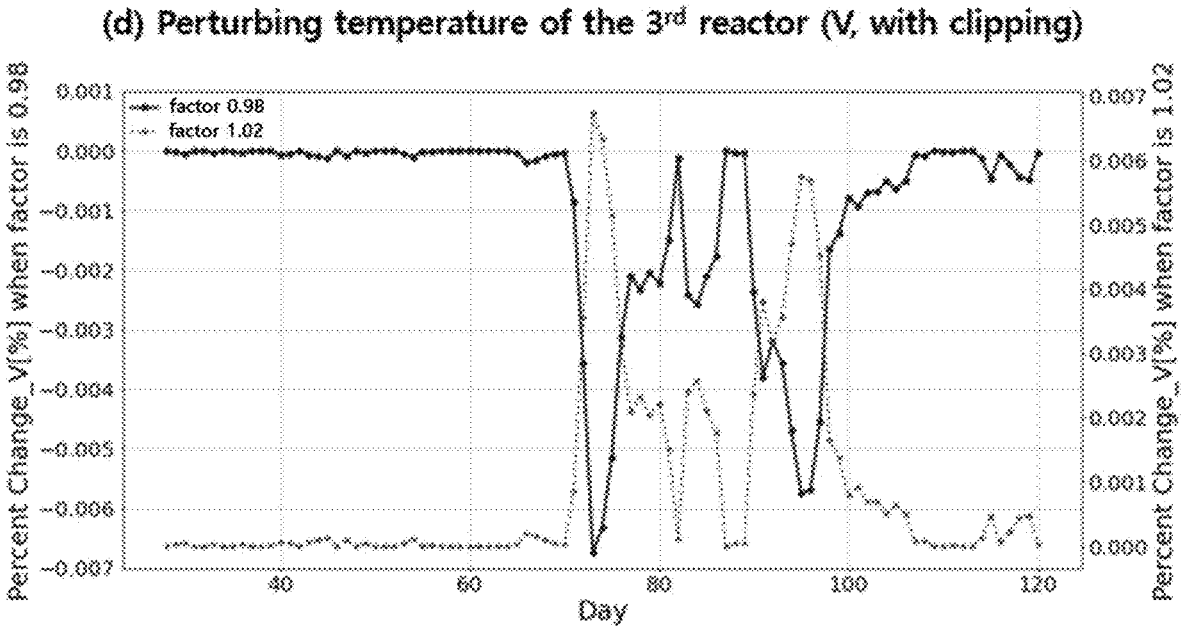
Figure 14:
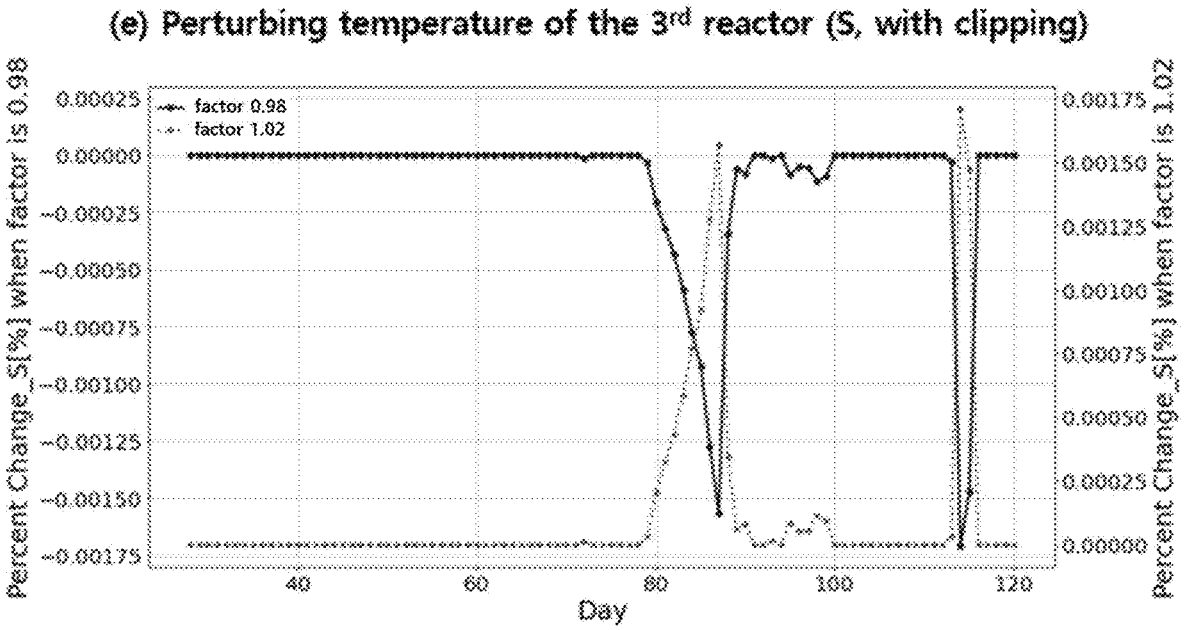

FIG. 4 shows a graph of the learning results of an impurity removal amount prediction model. The upper drawing of FIG. 4 shows a training cost graph according to each learning step, and the lower drawing of FIG. 4 shows a graph of actual plant data and predicted data through the model. The circular dots are the actual plant data collected, and the square dots are the result data derived through the trained model.

Referring to FIG. 4, when the model was first trained, the training cost rapidly decreased from the initial model. After this, small updates were made to the previously trained model with receding horizon strategy and recent 28 day data, and was shown as a smooth decrease in the slope of the training cost. When the actual training data and the predicted values were compared each day, it was found that the prediction model followed the actual plant data well.

[Analysis of Weight Clipping Application]

when weight clipping was not applied, the maximum percentage error was 10.19% and the average values were between 0.51-2.64%. Based on the error rate, there does not seem to be a significant performance difference between the FCNN models according to the embodiments of the present invention and the models not trained with the strategies of the present invention. However, when weight clipping was not used, the FCNN models predicted the removal amounts that were inconsistent with the physiochemical principles. To validate the effectiveness of the weight clipping strategy, the temperature in the feature set was perturbed by 2%. The other variables were kept constant and the percentage change in the removal amount was calculated.

FIGS. 5 to 9 show changes in the removal amounts of the impurities according to an increase or decrease in variables when weight clipping is not applied, and FIGS. 10 to 14 show changes in the removal amounts of the impurities according to an increase or decrease in variables when weighted clipping is applied.

Referring to FIGS. 5 to 14, in the actual RDS process, the yield decreases depending on the inactivity of the catalyst, and the operating temperature of the reactor is increased to meet the target yield. In the embodiments of the present invention, a weight clipping method was used to prevent the model from learning the opposite of this correlation, and it was checked that the trained prediction model did not violate the physiochemical laws. The solid lines of the graphs show the percentage change when the corresponding variable decreases by 2%. When weight clipping is not applied, the percentage changes in removal amounts are positive as the flow rate of the feed and the temperature of the reactor decrease, indicating a tendency for the removal amounts to increase. However, when weight clipping is applied, it can be seen that the removal amounts tend to decrease as the feed flow rate and reactor temperature decrease.

The dotted lines of the graphs show the percentage change when the corresponding variable increases by 2%. This is the opposite of when the variable decreases by 2%, so there should be a tendency for the removal amounts to increase. However, if weight clipping is not applied, the percentage change in removal amounts shows a negative value, indicating a tendency for the removal amounts to decrease. Likewise, when weight clipping is applied, the removal amounts tend to increase as the feed flow rate and reactor temperature increase, keeping other variables the same. Through this result graph, it is possible to check whether weight clipping is applied and the tendency of the removal amounts according to the increase or decrease of variables. When weight clipping is applied, it can be confirmed that the trained model does not violate the physiochemical laws and shows physical consistency.

[Analysis of Imbalance Learning Correction Between Prediction Models]

When conducting training without the penalty term for imbalances, the maximum value of the percentage error in the predicted values was 8.64%, and the average values were 1.16-2.73%.

According to the embodiments of the present invention, two FCNN models were applied to each impurity, and balanced learning can be achieved by adding a formula to correct the imbalance occurring between the two FCNN models to the objective function. The imbalance value between the models was calculated using the following percentage imbalance.

$$\text{Percent Imbalance}(\%) = \frac{NN_{T1,i}(X_{T1,i}) - NN_{T2,i}(X_{T2,i})}{NN_{T1,i}(X_{T1,i}) + NN_{T2,i}(X_{T2,i})} \times 100$$

Through the above equation, when two models are trained equally, there is no difference between the output values, so the imbalance value is close to 0. Conversely, when learning is biased towards one model, the difference in output values is large, so the imbalance value is 100 or −100. When comparing all impurities, the maximum imbalance value was found to be within 10%. The maximum and average values of imbalance values for each impurity model are shown in Table 5. The minimum value was excluded because it was very small.

TABLE 5

| | S | N | Ni | V | CCR |
|---|---|---|---|---|---|
| Maximum Percent Imbalance (%) | 1.36 | 7.88 | 9.71 | 4.24 | 7.36 |
| Average Percent Imbalance (%) | 0.26 | 0.30 | 0.62 | 0.36 | 0.53 |

As above, the exemplary embodiments of the present invention have been described. Those skilled in the art will appreciate that the present invention may be embodied in other specific ways without changing the technical spirit or essential features thereof. Therefore, the embodiments disclosed herein are not restrictive but are illustrative. The scope of the present invention is given by the claims, rather than the specification, and also contains all modifications within the meaning and range equivalent to the claims.

What is claimed is:

1. An impurity removal amount prediction method in chemical process comprising:

training neural network models using data from a chemical process;

predicting removal amounts of impurities removed in the chemical process using the trained neural network models; and performing the chemical process using operating conditions from the trained neural network models, wherein the impurities are included in the feed supplied to reactors of the chemical process and are removed by reacting with catalysts disposed in the reactors, wherein the reactors include a first reactor and a second reactor arranged in parallel, wherein the neural network models include a first neural network model applied to the first reactor and a second neural network model applied to the second reactor, wherein an objective function of the neural network models includes a penalty term for correcting a difference between output data of the first neural network model and output data of the second neural network model, and wherein the neural network models learn in the direction to minimize the difference between the output data of the first neural network model and the second neural network model.

2. The impurity removal amount prediction method of claim 1, wherein the chemical process includes RDS (Atmospheric Residue Desulfurization) process, the feed contains HS AR (High Sulfur Atmospheric Residue), and the impurities include sulfur, nitrogen, metal elements, and CCR (Conradson Carbon Residue).

3. The impurity removal amount prediction method of claim 1, wherein the correlation between input data and output data of the neural network models is fixed to a positive value using weight clipping.

4. The impurity removal amount prediction method of claim 1, wherein the removal amounts of the impurities are predicted using an aging factor indicating the inactivity of the catalysts.

5. The impurity removal amount prediction method of claim 1, wherein the neural network models are updated daily by applying a receding horizon method after learning for a certain period of time.

6. The impurity removal amount prediction method of claim 1, wherein the neural network models learn using variables that affect the removal amounts of the impurities as features.

* * * * *